US009318856B2

(12) United States Patent
MacDougall et al.

(10) Patent No.: US 9,318,856 B2
(45) Date of Patent: Apr. 19, 2016

(54) ELECTRICAL RECEPTACLE CONNECTOR AND ELECTRICAL PLUG CONNECTOR

(71) Applicant: ADVANCED-CONNECTEK INC., New Taipei (TW)

(72) Inventors: Alan MacDougall, New Taipei (TW); Wen-Yu Wang, New Taipei (TW); Ya-Fen Kao, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/624,348

(22) Filed: Feb. 17, 2015

(65) Prior Publication Data

US 2015/0303629 A1 Oct. 22, 2015

(30) Foreign Application Priority Data

Apr. 21, 2014 (TW) ..... 103206940 U
Sep. 22, 2014 (TW) ..... 103132680 A

(51) Int. Cl.
*H01R 13/648* (2006.01)
*H01R 24/60* (2011.01)
*H01R 13/6581* (2011.01)
*H01R 107/00* (2006.01)

(52) U.S. Cl.
CPC ..... *H01R 24/60* (2013.01); *H01R 13/6581* (2013.01); *H01R 2107/00* (2013.01)

(58) Field of Classification Search
CPC ..... H01R 23/688
USPC ..... 439/607.1, 607.04, 607.4, 924.1, 924.2, 439/188, 607.02, 607.17, 607.19, 607.35, 439/607.36
See application file for complete search history.

(56) References Cited

U.S. PATENT DOCUMENTS 4,544,227 A * 10/1985 Hirose ..... H01R 13/6583 439/607.17
5,975,957 A * 11/1999 Noda ..... H01R 13/65802 439/607.17
6,056,573 A * 5/2000 Nishioka ..... H01R 12/714 235/441
6,860,762 B2 * 3/2005 Spykerman ..... G11B 33/122 363/142
6,896,523 B2 * 5/2005 Nishizawa ..... G06K 19/07 439/60
6,902,407 B2 * 6/2005 Ito ..... G06K 7/0047 439/60
7,204,718 B2 * 4/2007 Lai ..... H01R 27/00 439/630
7,575,454 B1 * 8/2009 Aoki ..... H01R 13/641 439/188

(Continued)

*Primary Examiner* — Abdullah Riyami
*Assistant Examiner* — Nelson R Burgos-Guntin
(74) *Attorney, Agent, or Firm* — Muncy, Geissler, Olds & Lowe, P.C.

(57) ABSTRACT

An electrical receptacle connector provided to connect with an electrical plug connector. The electrical receptacle connector includes a metal shell, an insulation body and a the conductive contact members. The conductive contact members are disposed at the insulation body to connect with the metal shell. The electrical plug connector includes a metal shell and a tubular portion disposed at a front portion of the metal shell. When the electrical plug connector is plugged into the electrical receptacle connector, the surface of the tubular portion of the electrical plug connector is in contact with the conductive contact members.

15 Claims, 15 Drawing Sheets

(56) References Cited

U.S. PATENT DOCUMENTS 7,625,243 B2 * 12/2009 Chen ..... H01R 23/6873 439/541.5
7,758,379 B2 * 7/2010 Chen ..... H01R 13/6485 439/607.11
8,262,411 B2 * 9/2012 Kondo ..... H01R 13/6658 439/607.01
8,657,633 B2 * 2/2014 Shindo ..... H01R 13/405 439/660
8,662,927 B2 * 3/2014 Yu ..... H01R 4/023 439/498
8,851,927 B2 * 10/2014 Hsu ..... H01R 13/6594 439/607.11
8,961,242 B2 * 2/2015 Kim ..... H01R 13/04 439/60
9,209,573 B1 * 12/2015 Chen ..... H01R 13/6581
2015/0111428 A1 * 4/2015 Kao ..... H01R 13/6581 439/607.02
2015/0111433 A1 * 4/2015 Hou ..... H01R 12/707 439/626
2015/0263458 A1 * 9/2015 Guo ..... H01R 12/724 439/607.4
2015/0270646 A1 * 9/2015 Kao ..... H01R 13/6581 439/76.1
2015/0303623 A1 * 10/2015 Kao ..... H01R 13/6583 439/607.04
2016/0013595 A1 * 1/2016 Kao ..... H01R 24/60 439/607.55

* cited by examiner

300

| | | | | | | | | | | | | |
|---|---|---|---|---|---|---|---|---|---|---|---|---|
| GND | TX1+ | TX1− | VBUS | CC1 | D+ | D− | RFU | VBUS | RX2− | RX2+ | GND | 151 |
| GND | RX1+ | RX1− | VBUS | RFU | D− | D+ | CC2 | VBUS | TX2− | TX2+ | GND | 152 |

Fig. 5D

| | | | | | | | | | | | | |
|---|---|---|---|---|---|---|---|---|---|---|---|---|
| GND | RX2+ | RX2− | VBUS | RFU | D− | D+ | CC1 | VBUS | TX1− | TX1+ | GND | 251 |
| GND | TX2+ | TX2− | VBUS | CC2 | D+ | D− | RFU | VBUS | RX1− | RX1+ | GND | 252 |

Fig. 8C

ELECTRICAL RECEPTACLE CONNECTOR AND ELECTRICAL PLUG CONNECTOR

CROSS-REFERENCES TO RELATED APPLICATIONS

This non-provisional application claims priority under 35 U.S.C. §119(a) on Patent Application 103206940 and 103132680, filed in Taiwan, R.O.C. on Apr. 21, 2014 and Sep. 22, 2014, the entire contents of which are hereby incorporated by reference.

FIELD OF THE INVENTION

The present invention relates to an electrical connector, and more particular to an electrical receptacle connector and an electrical plug connector correspondingly connecting thereof.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is not sufficient. As a consequence, faster serial bus interfaces, USB 3.0, are developed, which may provide a higher transmission rate so as to satisfy the need of a variety devices.

With the continued and expected long-term success of the USB interface, there exists a need to adapt USB to serve newer computing platforms and devices as they trend toward to smaller, thinner, and lighter form factors. In some cases, when electrical connectors are made smaller, the conductive contacts or pins of electrical connectors are brought closer to each other thereby increasing the electromagnetic coupling between the electrical connectors. An increase in electromagnetic coupling may generate unwanted noise or crosstalk that negatively affects the performance of the electrical connector. One particular concern regarding electrical connector is to reduce electromagnetic interference (EMI) so as to meet the relevant EMI regulations. There is a need not only to minimize the EMI of electrical connectors but also to contain the EMI of the host system in which the electrical connector assembly is mounted, regardless of whether a plug connector is plugged into a receptacle connector. In conventional designs, EMI shielding is achieved using the metal shell. However, due to increasing the speed rate of signals being transmitted through the electrical connector assemblies when a plug connector is plugged into a receptacle connector, the EMI shielding provided by conventional shell is proving to be inadequate.

In addition, in order to accommodate end users with the attribute of usability, durability, and robustness of USB connectors and also meet the requirement of the connector insertion force lower than extraction force when inserting a plug connector into a receptacle connector or extracting a plug connector from a receptacle connector, the existing USB connectors could not meet all above-mentioned requirements.

SUMMARY OF THE INVENTION

The main objective of the present invention is to provide an electrical receptacle connector which comprises a metal shell, an insulation housing, a plurality of upper-row plate terminals, a plurality of lower-row plate terminals, and a plurality of conductive members or spring members. The metal shell defines a receptacle cavity that is configured to receive and enclose the insulation housing, a plurality of receptacle terminals, and the conductive contact members or spring members. The insulation housing mainly comprises a base portion and a tongue portion which is thinner than the base portion. The tongue portion is extended forwardly from the base portion in the front-to-rear direction. Two recessed portions are symmetrically disposed at a top side and a bottom side of the base portion respectively. One of the recessed portions is formed at the corner between the top side and a front side of the base portion the other recessed portions is formed at the corner between the bottom side and the front side of the base portion. The tongue portion comprises an upper surface and a lower surface. The upper-row plate terminals comprise a plurality of upper-row plate signal terminals, at least one upper-row plate power-supply terminal and at least one upper-row plate ground terminal. Each of the upper-row plate terminals is disposed at the base portion and the tongue portion, and located at the upper surface. The lower-row plate terminals comprise a plurality of lower-row plate signal terminals, at least one lower-row plate power-supply terminal and at least one lower-row plate ground terminal. The conductive contact members are respectively received in recessed portions symmetrically disposed at a top side and a bottom side of the base portion and respectively connected to the inner wall of the metal shell. Each conductive contact member comprises a body portion, a strip-shaped plate, and a plurality of elastic contact portions. Each body portion is arranged in the corresponding recessed portion. Each strip-shaped plate is extending and bending from the body portion to contact to the inner wall of the metal shell. The elastic contact portions are arched contact portions, which are extended from one sides of the body portions of the conductive contact members or spring members and protruded out of the front side of the base portion in the front-to-rear direction to correspond to the strip-shaped plate 1611. The arched contact portions are suspended above the upper part of the tongue portion or below the lower part of the tongue portion.

Another objective of the present invention is to provide an electrical plug connector, which comprises a metal shell, an insulation body and a plurality of upper-row elastic terminals and a plurality of lower-row elastic terminals. The metal shell includes a first tubular portion, a second tubular portion, a plug cavity defined by the first tubular portion, and a connecting portion extending from the first tubular portion where the first tubular portion and the second tubular portion form different surfaces. The insulation housing is received in the plug cavity and includes an upper portion, a lower portion and a terminal groove defined between the upper portion and the lower portion. The upper-row elastic terminals comprise a plurality of upper-row elastic signal terminals, at least one upper-row elastic power-supply terminal and at least one upper-row elastic ground terminal, and each of the upper-row elastic terminals is disposed at the insulation housing and located at a lower surface of the upper portion. The lower-row elastic terminals comprise a plurality of lower-row elastic signal terminals, at least one lower-row elastic power-supply terminal and at least one lower-row elastic ground terminal, and each of the lower-row elastic terminals is disposed at the insulation housing and located at an upper surface of the lower portion.

In conclusion, since the conductive contact members or spring members of the electrical receptacle connector are connected to the second tubular portion of the electrical plug connector when the electrical plug connector is plugged into the electrical receptacle connector, a low-impedance grounding path is effectively established between the metal shell of the electrical plug connector and the metal shell of the electrical receptacle connector such that the electromagnetic interference (EMI) can be further reduced so as to meet the relevant EMI regulations. In order to accommodate end users with the attribute of usability, durability, and robustness of USB connectors and also meet the requirement of the connector insertion force lower than extraction force when inserting a plug connector into a receptacle connector or extracting a plug connector from a receptacle connector, the amount of resistance between the metal shell of the electrical plug connector and the conductive contact members or spring members can be reduced through reducing the contact areas between the surfaces of the metal shell of the electrical plug connector and the conductive contact members or spring members. In addition, the amount of resistance between the metal shell of the electrical plug connector and the conductive contact members or spring members can be controlled through the geometry, material selection, surface finishing and sizing of the conductive contact members or spring members. Furthermore, because the upper-row plate terminals and the lower-row plate terminals of the electrical receptacle connector are arranged upside down, and the arrangement sequence of the upper-row plate terminals are left-right reversal with respect to the arrangement sequence of the lower-row plate terminals, the electrical plug connector is inserted into the interior of the electrical receptacle connector with the terminals of the electrical plug connector contacting with the upper-row plate terminals when being plugged by a forward orientation, and the electrical plug connector is inserted into the interior of the electrical receptacle connector with the terminals of the electrical plug connector contacting with the lower-row plate terminals when being plugged by a reverse direction. Therefore, the inserting orientation of the electrical plug connector is not limited, and can be forwarded or reversed, upon plugging into the electrical receptacle connector according to the present invention.

Detailed description of the characteristics and the advantages of the present invention is shown in the following embodiments, the technical content and the implementation of the present invention should be readily apparent to any person skilled in the art from the detailed description, and the purposes and the advantages of the present invention should be readily understood by any person skilled in the art with reference to content, claims and drawings in the disclosure.

BRIEF DESCRIPTION OF THE DRAWINGS

The disclosure will become more fully understood from the detailed description given herein below for illustration only, and thus are not limitative of the disclosure, and wherein:

FIG. 5D is a schematic configuration diagram of pins of the electrical receptacle connector shown in FIG. 4.

FIG. 8C is a schematic configuration diagram of pins of the electrical plug connector shown in FIG. 1.

DETAILED DESCRIPTION

Figure 1:
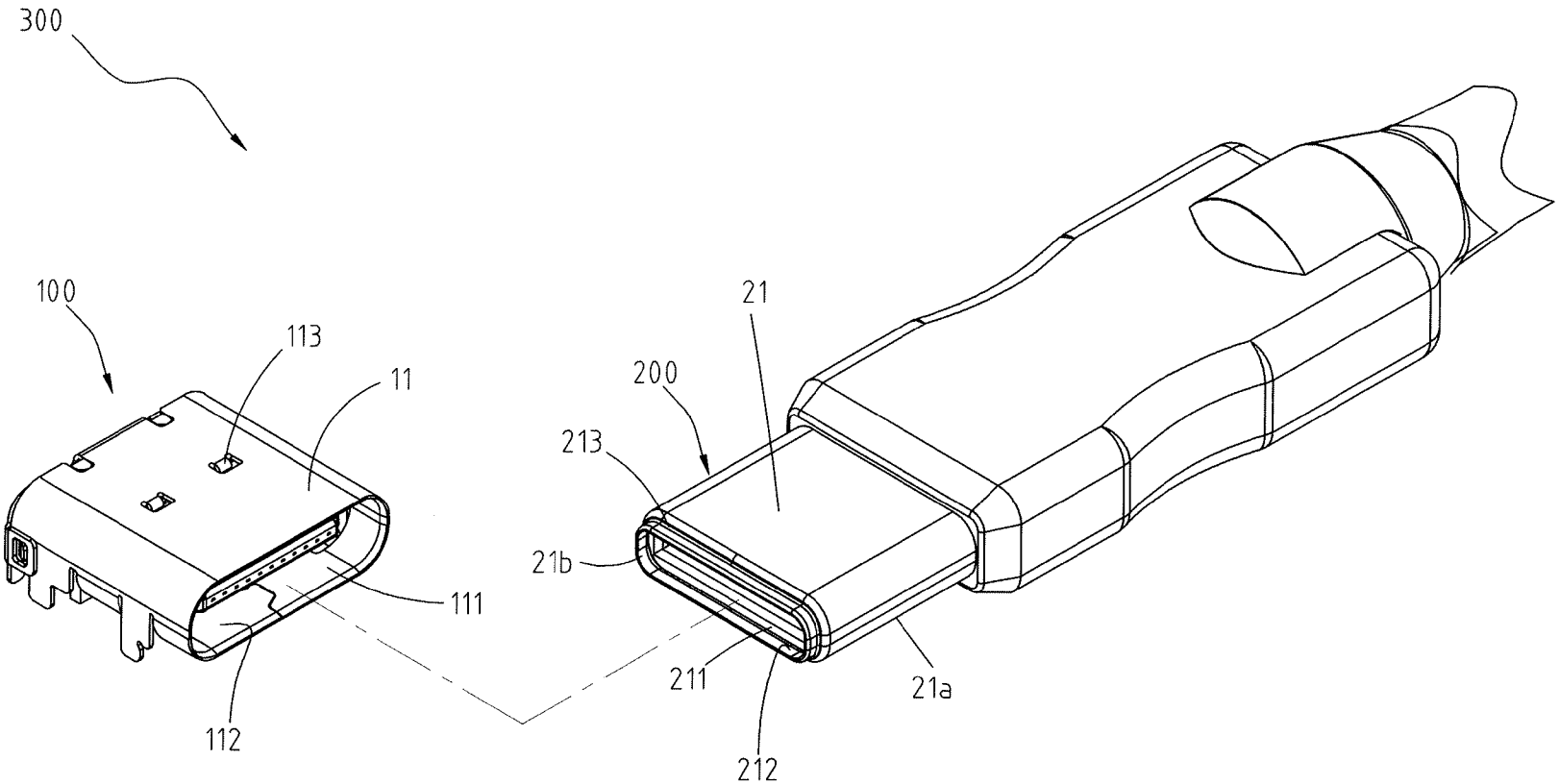
FIG. 1 is an exploded perspective view of an electrical connector assembly formed in an exemplary embodiment according to the present invention.
Figure 2:
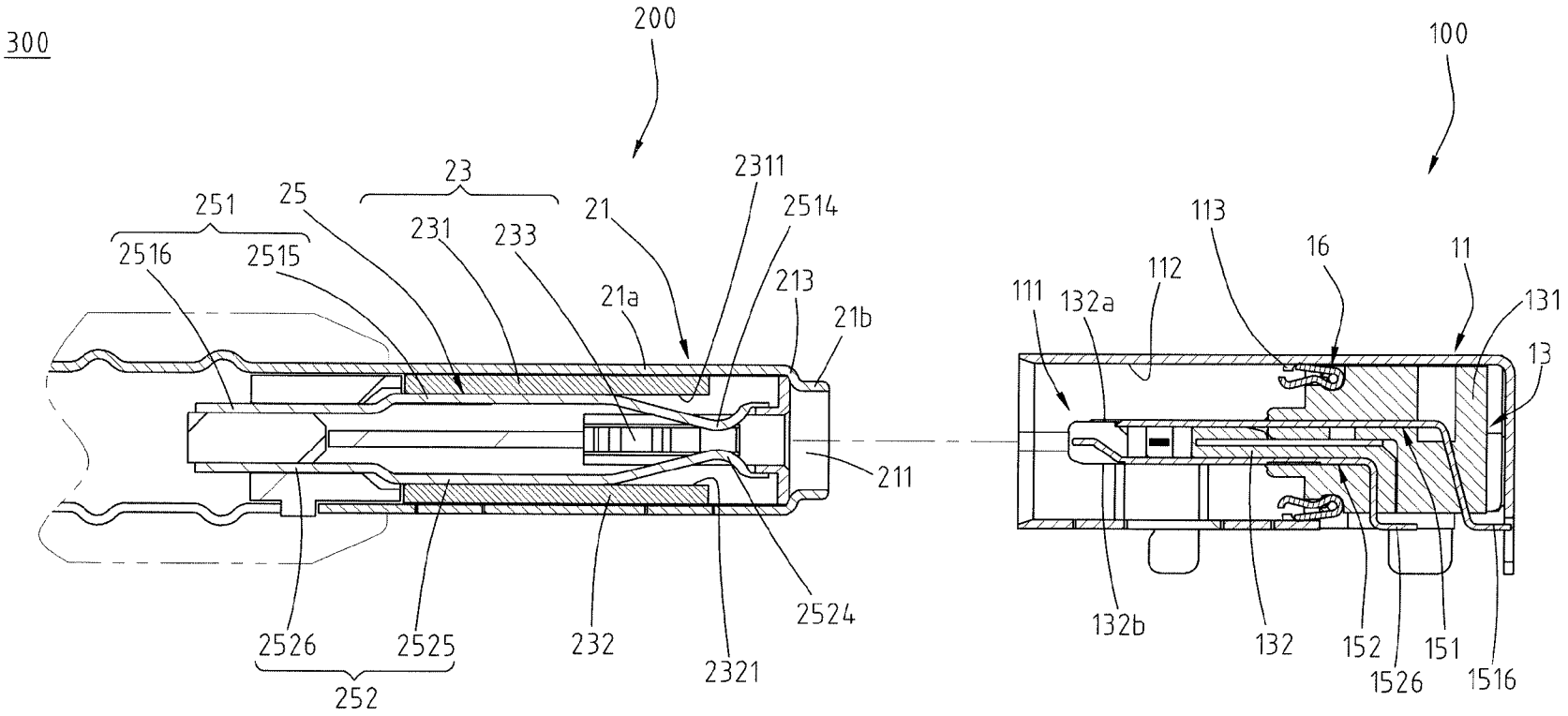
FIG. 2 is a cross-sectional view of an electrical receptacle connector and an electrical plug connector.
Figure 3:
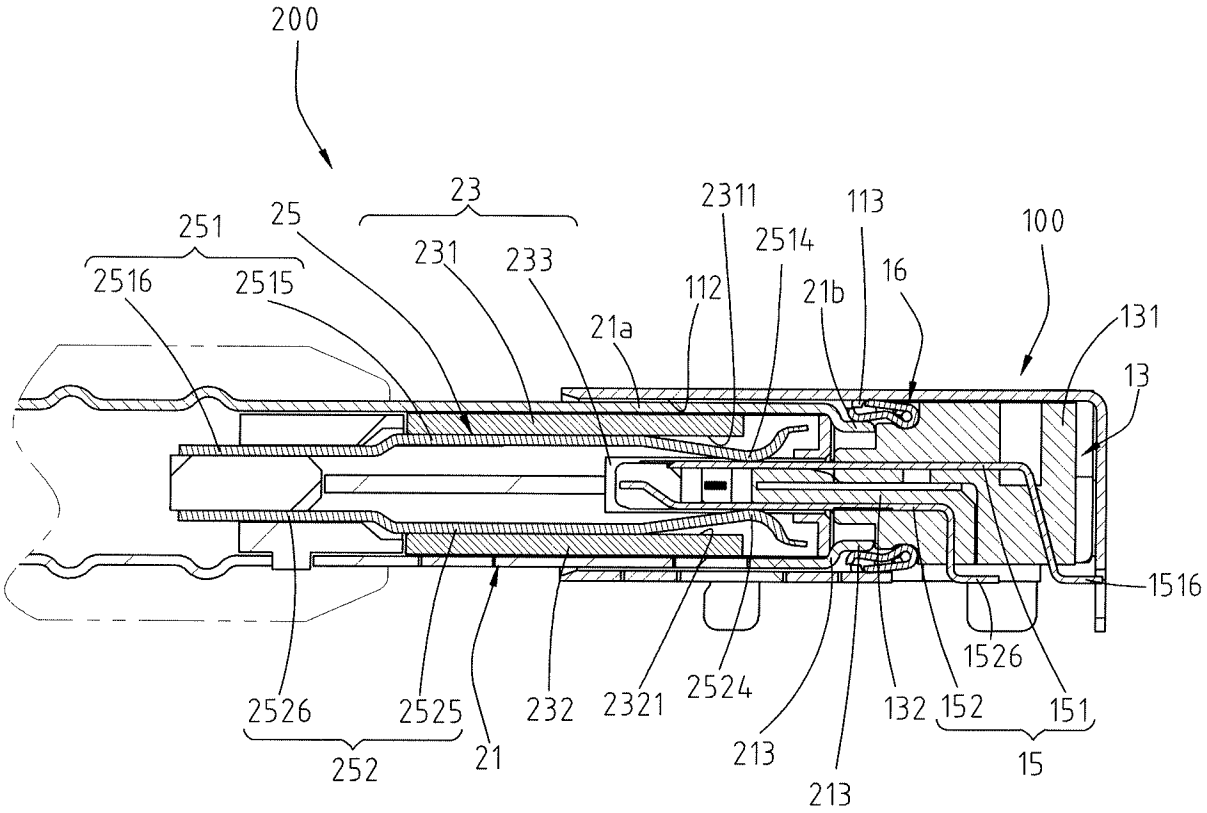
FIG. 3 is a cross-sectional view of the electrical connector assembly shown in FIG. 2, showing the electrical receptacle connector mated with the electrical plug connector.

Referring to FIGS. 1, 2 and 3, which illustrate an exemplary embodiment of an electrical connector assembly 300 according to the present invention. FIG. 1 illustrates an exploded perspective view of an electrical connector assembly 300. FIG. 2 illustrates a cross-sectional view of the electrical connector assembly 300 of FIG. 1, showing an electrical receptacle connector 100 and an electrical plug connector 200. FIG. 3 illustrates a cross-sectional view of the electrical connector assembly 300, showing the electrical receptacle connector 100 mated with the electrical plug connector 200.

Figure 4:
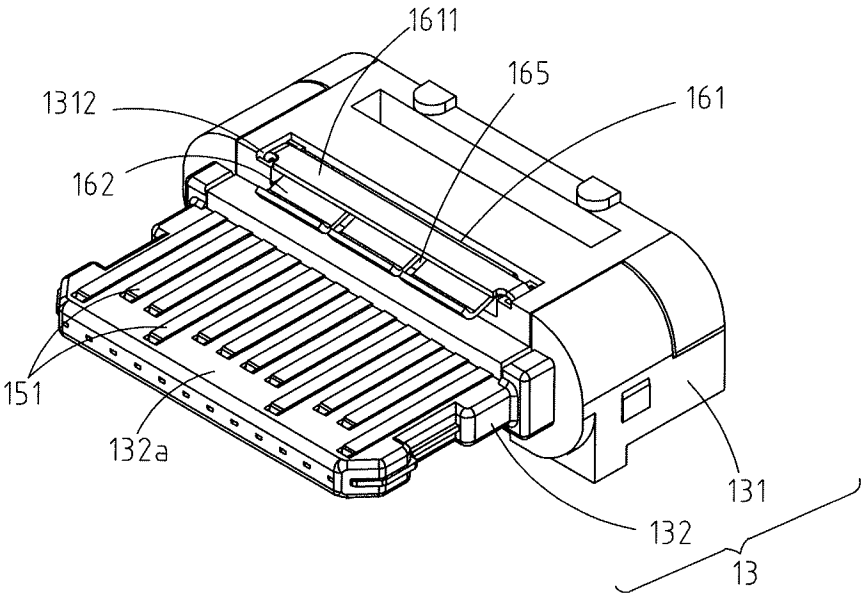
FIG. 4 is a perspective view of an electrical receptacle connector with a conductive contact member while a metal shell is eliminated from the electrical receptacle connector and according to an exemplary embodiment according to the present invention.
Figure 5:
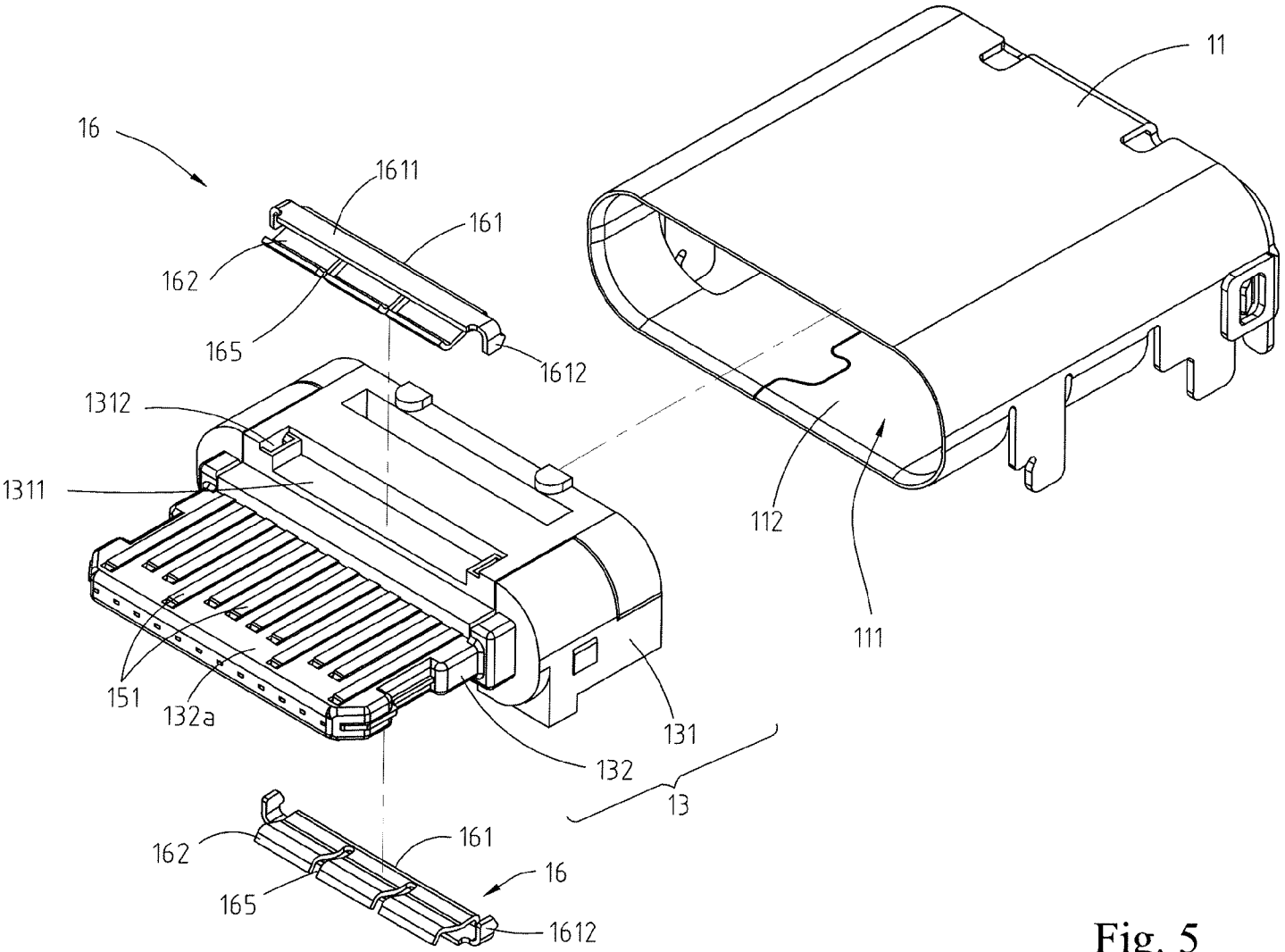
FIG. 5 is an exploded perspective view of the electrical receptacle connector shown in FIG. 4.

FIGS. 4 and 5 illustrate an exemplary embodiment of the electrical receptacle connector 100 according to the present invention. FIG. 4 clearly illustrates the perspective view showing that a plurality of conductive contact members or spring members 16 are located inside the electrical receptacle connector 100 and arranged on a top side of an insulation housing 13 while a metal shell 11 is eliminated from the electrical receptacle connector 100. The contact members 16 can be conductive spring members. The electrical receptacle connector 100 described herein is in accordance with the specification of a type-C USB connection interface and mainly comprises the metal shell 11, an insulation housing 13, a plurality of receptacle terminals 15 and a plurality of conductive contact members or spring members 16.

The metal shell 11 defines a receptacle cavity 111 that is configured to receive and enclose the insulation housing 13, the receptacle terminals 15 and the conductive contact members or spring members 16. The metal shell 11 is composed of, for example, a unitary or multi-piece member. Furthermore, the metal shell 11 defines an opening which is formed in the shape of, for example, oblong or rectangular and communicates with the receptacle cavity 111 of the metal shell 11.

Figure 5A:
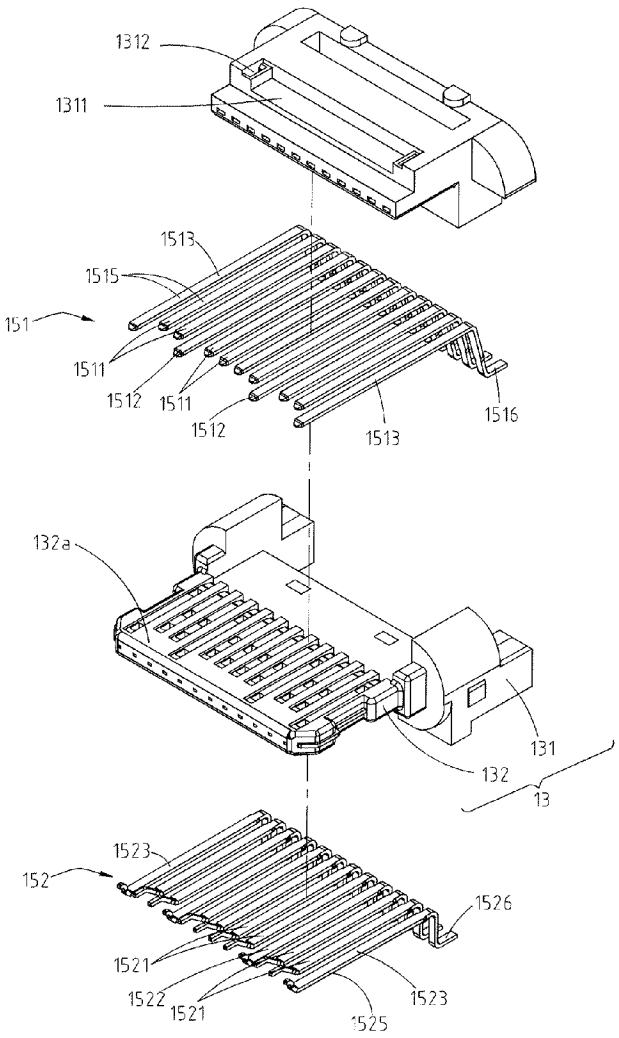
FIG. 5A is another exploded perspective view of the electrical receptacle connector shown in FIG. 4.
Figure 5B:
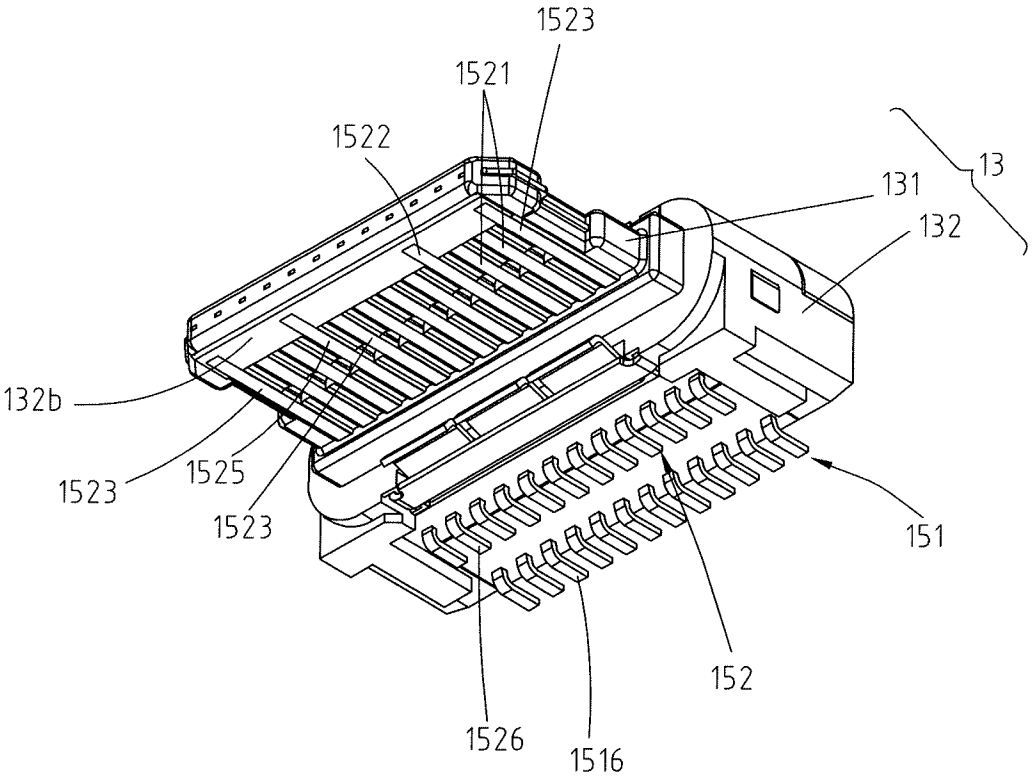
FIG. 5B is a perspective view showing a bottom of the electrical receptacle connector shown in FIG. 4.

Please refer to FIG. 5A and FIG. 5B, illustrating an exemplary embodiment of an electrical receptacle connector 100 according to the present invention. FIG. 5A is another exploded perspective view of the electrical receptacle connector 100 shown in FIG. 4. FIG. 5B is a perspective view showing a bottom of the electrical receptacle connector 100 shown in FIG. 4. The insulation housing 13 is received in the receptacle cavity 111 and mainly comprises a base portion 131 and a tongue portion 132 which is thinner than the base portion 131. For example, the base portion 131 and the tongue portion 132 may be integrally insert-molded or the like for production of an unitary member, named as the insulation housing 13. The tongue portion 132 is extended forwardly from the base portion 131 in the front-to-rear direction. For example, two recessed portions 1311 are symmetrically disposed at a top side and a bottom side of the base portion 131 respectively. One of the recessed portions 1311 is formed at the corner between the top side and a front side of the base portion 131. The other of the recessed portions 1311 is formed at the corner between the bottom side and the front side of the base portion 131. Two recessed portions 1311, 1311 are adjacent to an inner wall 112 of the metal shell 11. Furthermore, the tongue portion 132 has an upper surface 132*a* and a lower surface 132*b*.

The receptacle terminals 15 are held in the base portion 131 and the tongue portion 132 (referring to FIG. 2 and FIG. 4). The receptacle terminals 15 comprises a plurality of upper-row plate terminals 151 and a plurality of lower-row plate terminals 152.

Please refer to FIG. 5A, FIG. 5B, FIG. 5C and FIG. 5D, in which the upper-row plate terminals 151 are disposed at the base portion 131 and the tongue portion 132. The upper-row plate terminals 151 comprise a plurality of upper-row plate signal terminals 1511, at least one upper-row plate power-supply terminal 1512 and at least one upper-row plate ground terminal 1513. Each of the upper-row plate terminals 151 is disposed at the base portion 131 and the tongue portion 132, and located at the upper surface 132*a*. Refer to FIG. 5D, the upper-row plate terminals 151 include, from left to right, an upper-row plate ground terminal 1513 (Gnd), a first pair of differential signal terminals (TX1+−), a second pair of differential signal terminals (D+−), and a third pair of differential signal terminals (RX2+−) of the upper-row plate signal terminals 1511, upper-row plate power-supply terminals 1512 (Power/VBUS) between the three pairs of differential signal terminals, a retain terminal (RFU), (the retain terminal and a configuration channel 1 (CC1) are respectively arranged between the upper-row plate power-supply terminals 1512 and the second pair of differential signal terminals of the upper-row plate signal terminals 1511), and another upper-row plate ground terminal 1513 (Gnd).

Please refer to FIG. 5A, FIG. 5B, FIG. 5C and FIG. 5D, in which each of the upper-row plate terminals 151 comprises an upper-row contact section 1514, an upper-row connecting section 1515 and an upper-row welding section 1516. The upper-row connecting section 1515 is disposed at the base portion 131 and the tongue portion 132. The upper-row contact section 1514 is extending from one of two sides of the upper-row connecting section 1515 and disposed at the upper surface 132*a*, the upper-row welding section 1516 is extending from the other side of the upper-row connecting section 1515 and extends out of the base portion 131. The upper-row plate signal terminals 1511 are disposed at the upper surface 132*a* and transmitting first signals (that is, USB 3.0 signals). The upper-row welding section 1516 extends out of the bottom of the base portion 131 Furthermore, the upper-row welding section 1516 is bent horizontally and provided as a SMT pin, as shown in FIG. 5B.

Figure 5C:
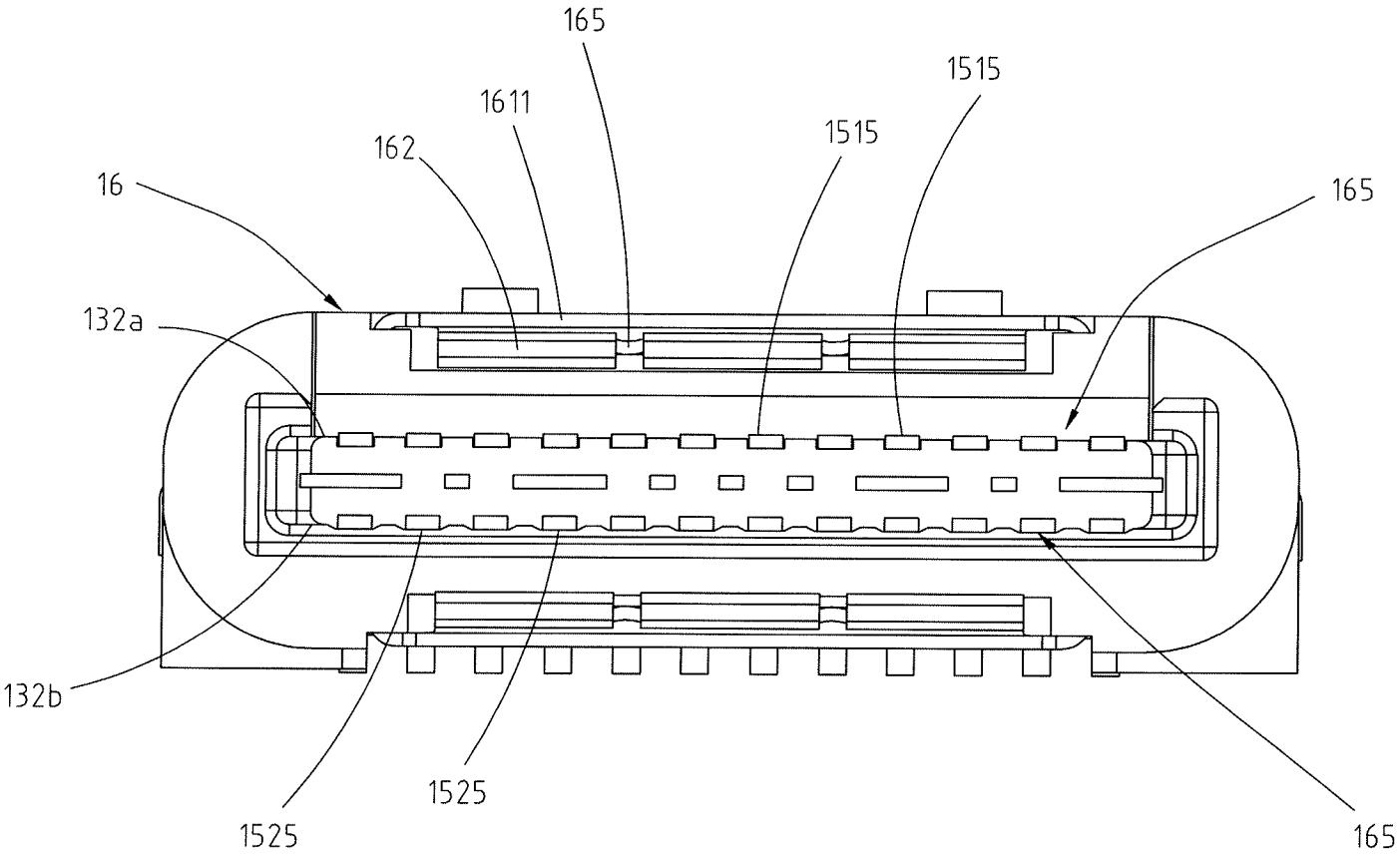
FIG. 5C is a cross-sectional view of the electrical receptacle connector shown in FIG. 4.

Please refer to FIG. 5A to FIG. 5D again, in which the lower-row plate terminals 152 are disposed at the base portion 131 and the tongue portion 132. The lower-row plate terminals 152 comprise a plurality of lower-row plate signal terminals 1521, at least one lower-row plate power-supply terminal 1522 and at least one lower-row plate ground terminal 1523. Each of the lower-row plate terminals 152 is disposed at the base portion 131 and the tongue portion 132, and located at the lower surface 132*b*. Refer to FIG. 5D, the lower-row plate terminals 152 include, from left to right, a lower-row plate ground terminal 1523 (Gnd), a first pair of differential signal terminals (TX2+−), a second pair of differential signal terminals (D+−), and a third pair of differential signal terminals (RX1+−) of the lower-row plate signal terminals 1521, lower-row plate power-supply terminals 1522 (Power/VBUS) between the three pairs of differential signal terminals, a retain terminal (RFU), (the retain terminal and a configuration channel 2 (CC2) are respectively arranged between the lower-row plate power-supply terminals 1522 and the second pair of differential signal terminals of the lower-row plate signal terminals 1521), and another lower-row plate ground terminal 1523 (Gnd).

Please refer to FIG. 5A, FIG. 5B, FIG. 5C and FIG. 5D, in which each of the lower-row plate terminals 152 comprises a lower-row contact section 1524, a lower-row connecting section 1525 and a lower-row welding section 1526. The lower-row connecting section 1525 is disposed at the base portion 131 and the tongue portion 132. The lower-row contact section 1524 is extending from one of two sides of the lower-row connecting section 1525 and disposed at the lower surface 132*b*, the lower-row welding section 1526 is extending from the other side of the lower-row connecting section 1525 and extends out of the base portion 131. The lower-row plate signal terminals 1521 are disposed at the lower surface 132*b* and transmitting second signals (that is, USB 3.0 signals). The lower-row welding section 1526 extends out of the bottom of the base portion 131. Furthermore, the lower-row welding section 1526 is bent horizontally and provided as a SMT pin, as shown in FIG. 5B.

Please refer to FIG. 5, FIG. 5A, FIG. 5B, FIG. 5C and FIG. 5D, in which embodiment, the upper-row plate terminals 151 and the lower-row plate terminals 152 are respectively disposed at the upper surface 132*a* and the lower surface 132*b* of the tongue portion 132. Furthermore, the upper-row plate terminals 151 and the lower-row plate terminals 152 are point-symmetrical with a central point of the receptacle cavity 111 as the symmetrical center. Here, point-symmetry means, after the upper-row plate terminals 151 (or the lower-row plate terminals 152) are rotated by 180 degrees with the symmetrical center as the rotating center, the upper-row plate terminals 151 and the lower-row plate terminals 152 are overlapped; that is, the rotated upper-row plate terminals 151 are arranged at the position of the original lower-row plate terminals 152, and the rotated lower-row plate terminals 152 are arranged at the position of the original upper-row plate terminals 151. In other words, the upper-row plate terminals 151 and the lower-row plate terminals 152 are arranged upside down, and the arrangement sequence of the upper-row contact sections 1514 are left-right reversal with respect to the arrangement sequence of the lower-row contact sections 1524. The electrical plug connector 200 is inserted into the interior of the electrical receptacle connector 100 with a forward orientation for transmitting first signals; conversely, the electrical plug connector 200 is inserted into the interior of the electrical receptacle connector 100 with a reverse orientation for transmitting second signals. The specification for transmitting the first signals conforms to that for transmitting the second signals. Based on this, the inserting orientation of the electrical plug connector 200 is not limited, and can be forwarded or reversed, upon plugging into the electrical receptacle connector 100 according to the present invention.

Please refer to FIG. 5A, FIG. 5B, FIG. 5C and FIG. 5D again; in which embodiment, positions of upper-row plate terminals 151 correspond to those of the lower-row plate terminals 152.

The conductive contact members or spring members 16 are respectively received in the corresponding recessed portions 1311 symmetrically disposed at a top side and a bottom side of the base portion 131 and respectively connected to the inner wall 112 of the metal shell 11. Each conductive contact member or spring member 16 comprises a body portion 161, a strip-shaped plate 1611 and a plurality of elastic contact portions 162. From a cross-sectional view, each body portion 161 is arranged in the corresponding recessed portion 1311. Each strip-shaped plate 1611 is extending and bending from the body portion 161 (that is, bending upwardly), to contact to the inner wall 112 of the metal shell 11. The elastic contact portions 162 are arched contact portions, which are extended from one side of the strip-shaped plate 1611 of each body portion 161 and protruded out of the front side of the base portion 131 in the front-to-rear direction to correspond to the strip-shaped plate 1611. The arched contact portions 162 are suspended above the upper part of the tongue portion 132 or below the lower part of the tongue portion 132.

Referring to FIG. 4 and FIG. 5, in this embodiment, the strip-shaped plate 1611 is extending and bending from one of two sides of the body portion 161, and the elastic contact portions 162 are extending from the other side of the body portion 161. The strip-shaped plate 1611 is connected to the inner wall 112 of the metal shell 11. Each strip-shaped plate 1611 is formed in the shape of a horizontal sheet parallel attached to the inner wall 112 of the metal shell 11. The inner wall 112 of the metal shell 11 and the strip-shaped plates 1611 are fixedly attached by laser welding through an outer wall of the metal shell 11. In other words, a plurality of corresponding connection points are formed between the metal shell 11 and the surfaces of the strip-shaped plates 1611. In some implementation aspects, the surfaces of the strip-shaped plates 1611 can be provided with a plurality of convex hull structures propping against the inner wall 112 of the metal shell 11 in order to physically connect the strip-shaped plates 1611 to the metal shell 11. Alternatively, the metal shell 11 can be provided with the convex hull structures and the convex hulls are arranged on the inner wall 112 and propped against the surfaces of the strip-shaped plates 1611 in order to connect the metal shell 11 to the surfaces of the strip-shaped plates 1611.

Referring to FIG. 4 and FIG. 5, in the embodiment, the base portion 131 comprises a plurality of catching grooves 1312 arranged at the two sides of the recessed portions 1311. The conductive contact members or spring members 16 further comprise a plurality of mounting legs 1612 bilaterally downwardly or upwardly extending from the two opposite lateral sides of the strip-shaped plates 1611 for fastening to the corresponding catching grooves 1312 so as to effectively mount the conductive contact member or spring members 16 onto the base portion 131 and further allowing the strip-shaped plate 1611 directly contacting with the inner wall 112 of the metal shell 11.

Referring to FIG. 4 and FIG. 5, the conductive contact members or spring members 16 further define a plurality of slots or cutout areas 165 formed between the elastic contact portions 162. The slots or cutout areas 165 can be cutout areas of the contact portions 162. Every two adjacent slots or cutout areas 165 are spaced apart a distance such that the elastic contact portions 162 are formed in the shape of arched contact pieces and extended from one sides of the body portions 161. When the electrical plug connector 200 is plugged into the electrical receptacle connector 100, the metal shell of the electrical plug connector 200 can be in contact with the conductive contact members or spring members 16. The conductive contact members or spring members 16 may provide the increased resistance when the electrical receptacle connector 100 is mated with the electrical plug connector 200. In order to accommodate end users with the attribute of usability, durability, and robustness of USB connectors and also to meet the requirement of the connector insertion force lower than extraction force when inserting a plug connector into a receptacle connector or extracting a plug connector from a receptacle connector, the amount of resistance between the metal shell of the electrical plug connector 200 and the conductive contact members or spring members 16 can be reduced through reducing the contact areas between the surfaces of the metal shell of the electrical plug connector 200 and the conductive contact members or spring members 16 when in contact. In addition, the amount of resistance between the metal shell of the electrical plug connector 200 and the conductive contact members or spring members 16 can be controlled through the geometry, material selection, surface finishing and sizing of the conductive contact members or spring members 16.

Figure 7:
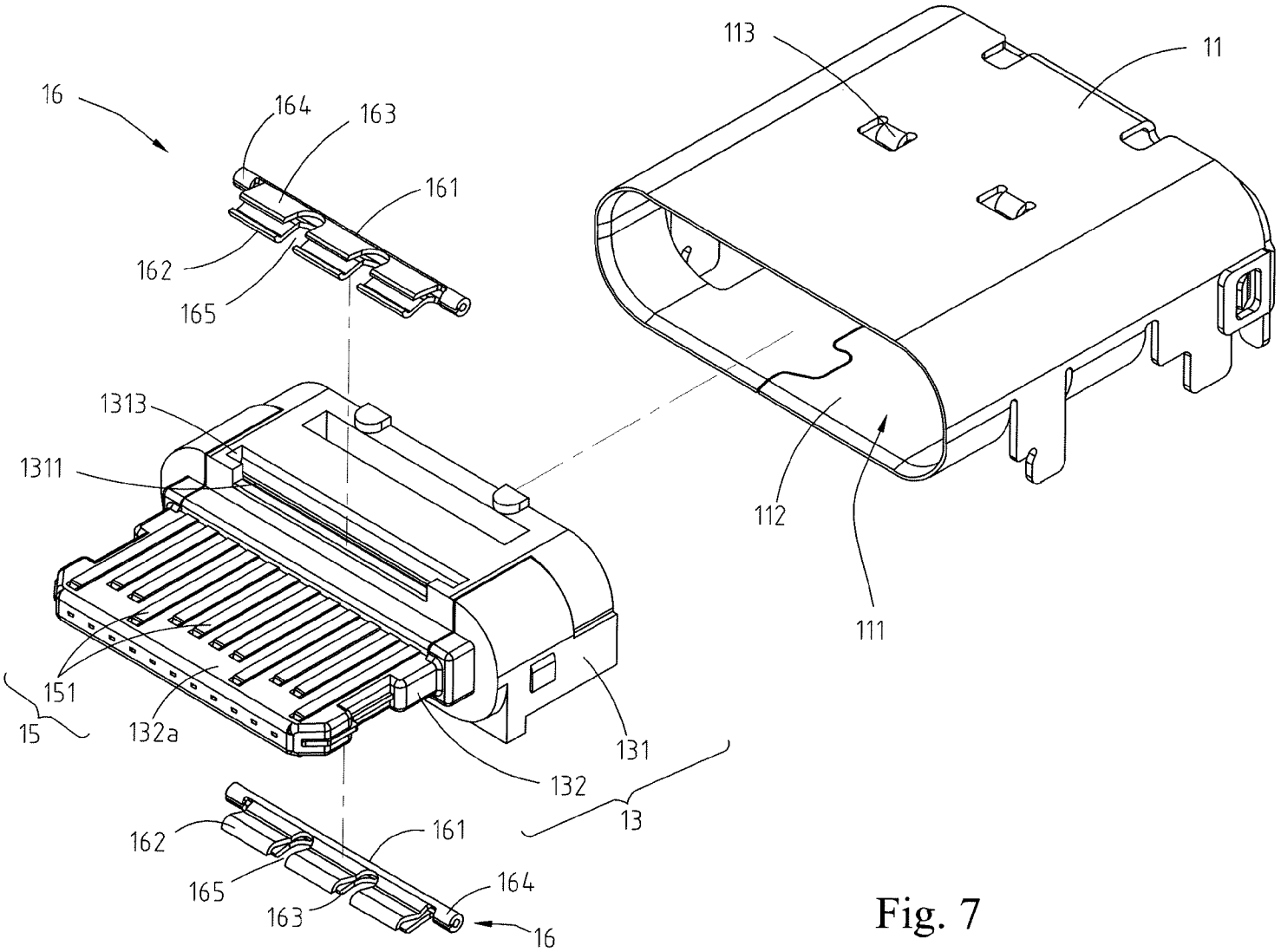
FIG. 7 is an exploded perspective view of the conductive contact member or spring member of the electrical receptacle connector shown in FIG. 6.

Referring to FIG. 5, for example, the larger slot or cutout areas 165 of the conductive contact members or spring members 16 are removed, the more resistance between the metal shell of the electrical plug connector 200 and the conductive contact members or spring members 16 will be reduced. Referring also to FIG. 7, for example, the conductive slot or cutout areas 165 of the conductive contact member or spring members 16 are removed, the more resistance between the metal shell of the electrical plug connector 200 and the conductive contact members or spring members 16 will be reduced such that the requirement of the connector insertion force lower than extraction force when inserting the electrical plug connector 200 into the electrical receptacle connector 100 or extracting the electrical plug connector 200 from the electrical receptacle connector 100 is facilitated to meet.

Figure 6:
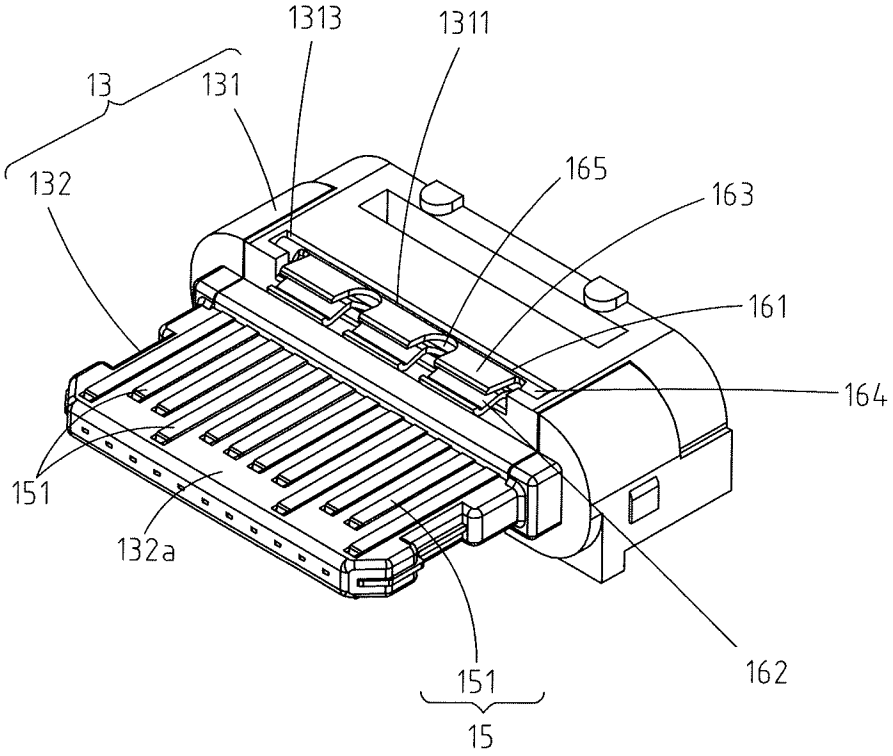
FIG. 6 is a perspective view of the electrical receptacle connector with a spring member and according to another exemplary embodiment according to the present invention.

Referring to FIG. 6 and FIG. 7, FIG. 6 clearly shows the external view that the conductive contact members or spring members 16 are arranged on the insulation housing 13 while the metal shell 11 is eliminated from the electrical receptacle connector 100. Each conductive contact member or spring member 16 described herein include a body portion 161 with a plurality of pairs of contact arms each divided into an upper contact portion 163 and a lower contact portion 162, respectively. From a cross-sectional view, each pair of contact arms has a V shape. The body portion 161 of each conductive contact member or spring member 16 can be treated as a backbone portion. Each upper contact portion 163 is extended upwardly and forwardly from an upper side of the backbone portion in the front-to-rear direction, thereby freely contacting to the inner wall 112 of the metal shell 11; that is, the upper contact portions 163 and the metal shell 11 are not fastened with each other, by welding techniques, in advance. Furthermore, each lower contact portion 162 is extended downwardly and forwardly from a lower side of the backbone portion in the front-to-rear direction, thereby suspending above and below the tongue portion 132. When inserting the electrical plug connector 200 into the electrical receptacle connector 100, the electrical plug connector 200 can prop against the lower contact portions 162 such that the upper contact portions 163 are movably contacted with the inner wall 112 of the metal shell 11. In other words, the upper contact portions 163 can be driven to swing due to the swing of the lower contact portions 162 such that the upper contact portions 163 are in contact with the inner wall 112 of the metal shell 11. Furthermore, the top or bottom wall of the metal shell 11 defines a plurality of taps 113 extending downwardly and slantwise from a middle portion thereof for cooperating with the front ends of the upper contact portions 163 (shown in FIG. 2) so as to improve the durability and robustness of the conductive contact member or spring members 16 received in the corresponding recessed portions 1311.

Please refer to FIG. 6 and FIG. 7, in which each conductive contact member or spring member 16 further comprises shaft portions 164 arranged at the two lateral sides of each body portion or backbone portion 161. The base portion 131 comprises bearing portions 1313, which receive corresponding shaft portions 164 of the conductive contact member or spring member 16, formed at the two lateral sides of the recessed portions 1311. In other words, the conductive contact members or spring members 16 are rotatably attached to the body portion or backbone portion 161 and the shaft portions 164 are pivoted on the corresponding bearing portions 1313. The upper contact portions 163 and the lower contact portions 162 are suspended slightly above the tongue portion 132. When the electrical plug connector 200 is plugged into the electrical receptacle connector 100, the metal shell of the electrical plug connector 200 can be in contact with the lower contact portions 162, and the lower contact portions 162 rotate around the corresponding shafts 164 and simultaneously drive the upper contact portions 163 to be in contact with the inner wall 112 of the metal shell 11.

Referring to FIG. 6 and FIG. 7, the conductive contact members or spring members 16 further define the cutout areas 165 which are formed between the lower contact portions 162 and the upper contact portions 163. Adjacent cutout areas 165 are spaced apart at a distance such that each conductive contact member or spring member 16 is formed in the V shape with a pair of contact arm, upper contact portion 163 and lower contact portion 162, respectively. The conductive contact members or spring members 16 may provide the increased resistance when the electrical receptacle connector 100 is mated with the electrical plug connector 200. In order to accommodate end users with the attribute of usability, durability, and robustness of USB connectors and also to meet the requirement of the connector insertion force lower than extraction force when inserting a plug connector into a receptacle connector or extracting a plug connector from a receptacle connector, the amount of resistance between the metal shell of the electrical plug connector 200 and the conductive contact members or spring members 16 can be reduced through reducing the contact area between the surfaces of the metal shell of the electrical plug connector 200 and the conductive contact members or spring members 16 in contact. In addition, the amount of resistance between the metal shell of the electrical plug connector 200 and the conductive contact members or spring members 16 can be controlled through the geometry, material selection, surface finishing and sizing of the conductive contact members or spring members 16.

Figure 8:
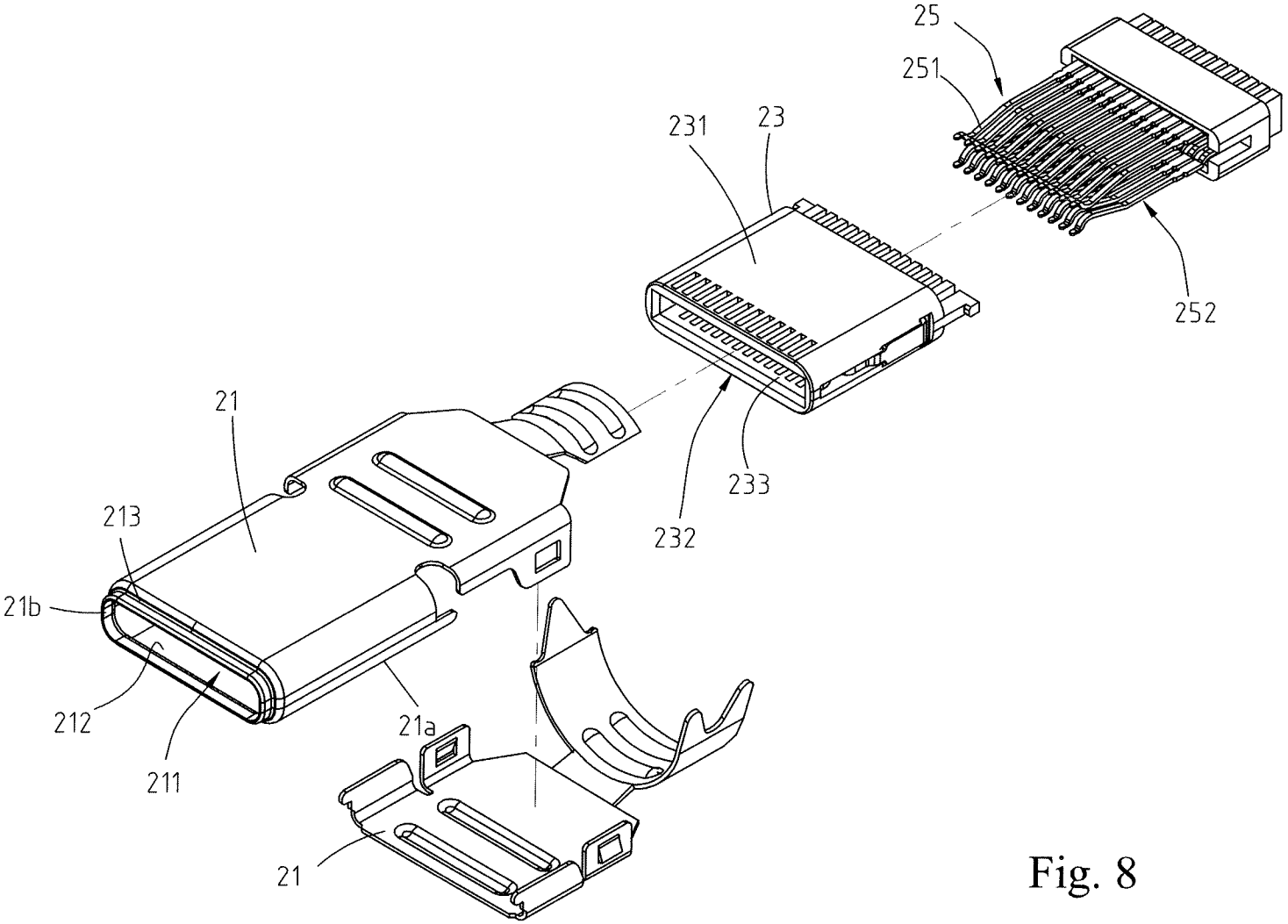
FIG. 8 is an exploded perspective view of the electrical plug connector shown in FIG. 1.

Referring to FIG. 2, FIG. 3 and FIG. 8, illustrating an exemplary embodiment of the electrical plug connector 200 according to the present invention. The electrical plug connector 200 described herein is in accordance with the specification of a type-C USB connection interface and mainly comprises a metal shell 21, an insulation housing 23 and a plurality of plug terminals 25.

The metal shell 21 defines a plug cavity 211 that is configured to receive and enclose the insulation housing 23 and the plug terminals 25. The metal shell 21 is composed of, for example, a unitary or multi-piece member. The metal shell 21 comprises a first tubular portion 21*a*, a second tubular portion 21*b*, a plug cavity 211 defined by the first tubular portion, and a connecting portion 213 extending from the first tubular portion 21*a* where the first tubular portion 21*a* and the second tubular portion 21*b* form different surfaces.

In this embodiment, the first tubular portion 21*a* and the second tubular portion 21*b* are formed by applying suitable deep-drawing techniques to the metal shell 21; that is, suitable deep-drawing techniques are applied to a conductive metal sheet to gradually deform the conductive metal sheet into the first tubular portion 21*a* and the second tubular portion 21*b* by repeating a plurality of pressing operations. The connecting portion 213 is bent with a small radius of curvature and smoothly connected between the first tubular portion 21*a* and the second tubular portion 21*b*. The second tubular portion 21*b* is defined at the front of the metal shell 21 for contacting the conductive contact members or spring members 16 of the electrical receptacle connector 100 when the electrical plug connector 200 is plugged into the electrical receptacle connector 100

Furthermore, the second tubular portion 21*b* defines an opening 212 at the front thereof which is formed in the shape of, for example, oblong or rectangular corresponding to the plug cavity 211 of the metal shell 21. The cross-sectional area of the second tubular portion 21*b* is slightly smaller than that of the connecting portion 213 of the metal shell 21.

The insulation housing 23 is received in the plug cavity 211 and is divided into an upper portion 231 and a lower portion 232. The insulation housing 23 further comprises a terminal groove 233 defined between the upper portion 231 and the lower portion 232. The upper portion 231 or the lower portion 232 of the insulation housing 23 may be insert molded or the like for production of an unitary member. Furthermore, a lower surface 2311 of the upper portion 231 corresponds to an upper surface 2321 of the lower portion 232.

The plug terminals 25 are disposed at the upper portion 231 and the lower portion 232. The plug terminals comprise a plurality of upper-row elastic terminals 251 and a plurality of lower-row elastic terminals.

Figure 8A:
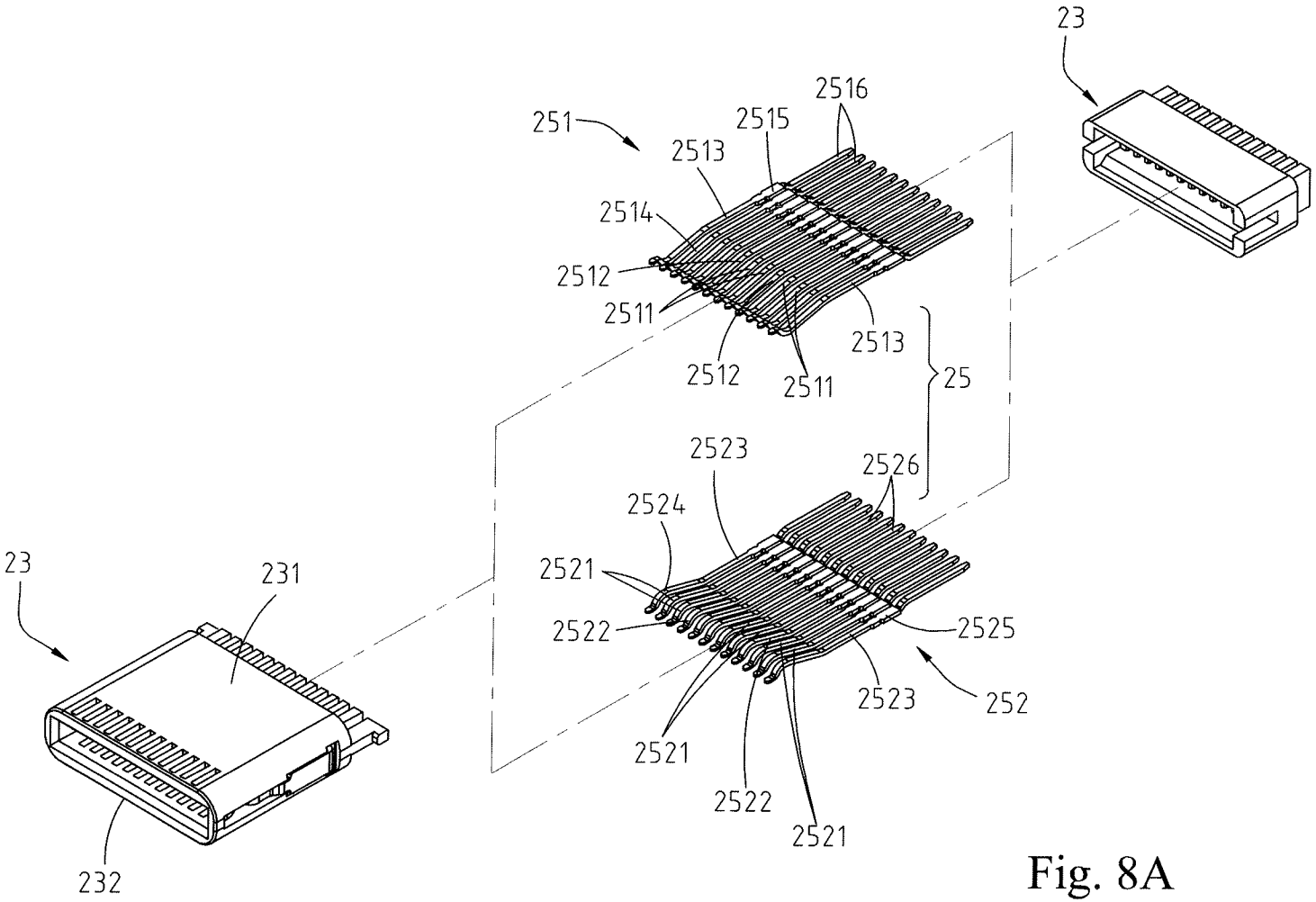
FIG. 8A is another exploded perspective view of the electrical plug connector shown in FIG. 1.
Figure 8B:
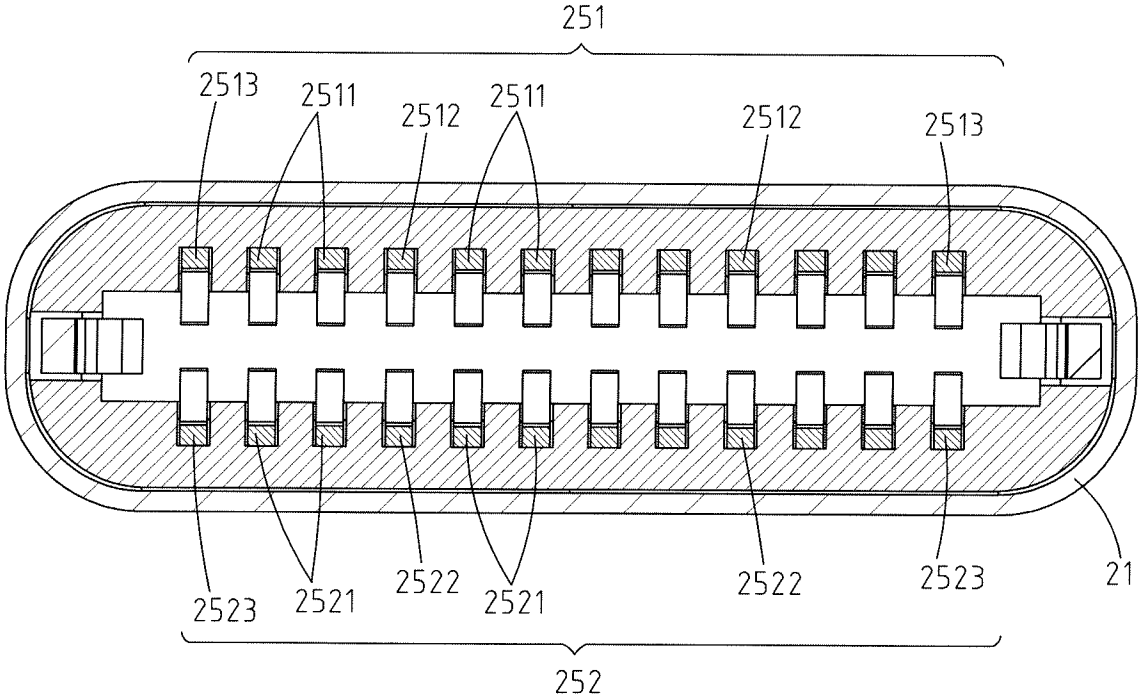
FIG. 8B is a cross-sectional view of the electrical plug connector shown in FIG. 1.

Please further refer to FIG. 8A, FIG. 8B and FIG. 8C. FIG. 8A is another exploded perspective view of the electrical plug connector 200 shown in FIG. 1. FIG. 8B is a cross-sectional view of the electrical plug connector 200 shown in FIG. 1. FIG. 8C is a schematic configuration diagram of pins of the electrical plug connector 200 shown in FIG. 1. As shown, the upper-row elastic terminals 251 are disposed at the insulation housing 23 and located at the lower surface 2311 of the upper portion 231. In this embodiment, the upper-row elastic terminals 251 comprises a plurality of upper-row elastic signal terminals 2511, at least one upper-row elastic power-supply terminal 2512 and at least one upper-row elastic ground terminal 2513, and each of the upper-row elastic terminals 251 is disposed at the insulation housing 23 and located at the lower surface 2311 of the upper portion 231. Refer to FIG. 8C, the upper-row elastic terminals 251 include, from left to right, an upper-row elastic ground terminal 2513 (Gnd), a first pair of differential signal terminals (TX1+−), a second pair of differential signal terminals (D+−), and a third pair of differential signal terminals (RX2+−) of the upper-row elastic signal terminals 2511, upper-row elastic power-supply terminals 2512 (Power/VBUS) between the three pairs of differential signal terminals, a retain terminal (RFU), (the retain terminal and a configuration channel 1 (CC1) are respectively arranged between the upper-row elastic power-supply terminals 2512 and the second pair of differential signal terminals of the upper-row elastic signal terminals 2511), and another upper-row elastic ground terminal 1523 (Gnd).

Please refer to FIG. 8A, FIG. 8B and FIG. 8C again, in which each of the upper-row elastic terminals 251 comprises an upper-row contact section 2514, an upper-row connecting section 2515 and an upper-row welding section 2516. The upper-row connecting section 2515 is disposed at the upper portion 231. The upper-row contact section 2514 is extending from one of two sides of the upper-row connecting section 2515 and disposed at the lower surface 2311 of the upper portion 231, and the upper-row welding section 2516 is extending from the other side of the upper-row connecting section 2515 and extends out of the insulation housing 23. The upper-row elastic signal terminals 2511 are extended toward the terminal groove 233 so as to be received in the terminal groove 233 for transmitting first signals (that is, USB 3.0 signals). The upper-row welding sections 2516 are extended from the rear part of the insulation housing 23, provided to be aligned horizontally, as shown in FIG. 8A.

Please refer to FIG. 8A, FIG. 8B, and FIG. 8C; in which the lower-row elastic terminals 252 are disposed at the insulation housing 23 and located at the upper surface 2321 of the lower portion 232. In this embodiment, the lower-row elastic terminals 252 comprises a plurality of lower-row elastic signal terminals 2521, at least one lower-row elastic power-supply terminal 2522 and at least one lower-row elastic ground terminal 2523, and each of the lower-row elastic terminals 252 is disposed at the insulation housing 23 and located at the upper surface 2321 of the lower portion 232. Refer to FIG. 8C, the lower-row elastic terminals 252 include, from left to right, a lower-row elastic ground terminal 2523 (Gnd), a first pair of differential signal terminals (TX2+−), a second pair of differential signal terminals (D+−), and a third pair of differential signal terminals (RX1+−) of the lower-row elastic signal terminals 2521, lower-row elastic power-supply terminals 2522 (Power/VBUS) between the three pairs of differential signal terminals, a retain terminal (RFU), (the retain terminal and a configuration channel 2 (CC2) are respectively arranged between the lower-row elastic power-supply terminals 2522 and the second pair of differential signal terminals of the lower-row elastic signal terminals 2521), and another lower-row elastic ground terminal 2523 (Gnd).

Please refer to FIG. 8A, FIG. 8B and FIG. 8C again, in which each of the lower-row elastic terminals 252 comprises a lower-row contact section 2524, a lower-row connecting section 2525 and a lower-row welding section 2526. The lower-row connecting section 2525 is disposed at the lower portion 232. The lower-row contact section 2524 is extending from one of two sides of the lower-row connecting section 2525 and disposed at the upper surface 2321 of the lower portion 232, and the lower-row welding section 2526 is extending from the other side of the lower-row connecting section 2525 and extends out of the insulation housing 23. The lower-row elastic signal terminals 2521 are extended toward the terminal groove 233 so as to be received in the terminal groove 233 for transmitting second signals (that is, USB 3.0 signals). The lower-row welding sections 2526 are extended from the rear part of the insulation housing 23, provided to be aligned horizontally, as shown in FIG. 8A.

Please refer to FIG. 8, FIG. 8B and FIG. 8C again, in which embodiment, the upper-row elastic terminals 251 and the lower-row elastic terminals 252 are respectively disposed at the lower surface 2311 of the upper portion 231 and the upper surface 2321 of the lower portion 132. Furthermore, the upper-row elastic terminals 251 and the lower-row elastic terminals 252 are point-symmetrical with a central point of the plug cavity 211 as the symmetrical center. Here, point-symmetry means, after the upper-row elastic terminals 251 (or the lower-row elastic terminals 252) are rotated by 180 degrees with the symmetrical center as the rotating center, the upper-row elastic terminals 251 and the lower-row elastic terminals 252 are overlapped; that is, the rotated upper-row elastic terminals 251 are arranged at the position of the original lower-row elastic terminals 252, and the rotated lower-row elastic terminals 252 are arranged at the position of the original upper-row elastic terminals 251. In other words, the upper-row elastic terminals 251 and the lower-row elastic terminals 252 are arranged upside down, and the arrangement sequence of the upper-row contact sections 2514 are left-right reversal with respect to the arrangement sequence of the lower-row contact sections 2524. The electrical plug connector 200 is inserted into the interior of the electrical receptacle connector 100 with a forward orientation for transmitting first signals; conversely, the electrical plug connector 200 is inserted into the interior of the electrical receptacle connector 100 with a reverse orientation for transmitting second signals. The specification for transmitting the first signals conforms to those for transmitting the second signals. Based on this, the inserting orientation of the electrical plug connector 200 is not limited, and can be forwarded or reversed, upon plugging into the electrical receptacle connector 100 according to the present invention.

Please refer to FIG. 8A, FIG. 8B and FIG. 8C again; in which embodiment, positions of upper-row elastic terminals 251 correspond to those of the lower-row elastic terminals 252.

When the electrical plug connector 200 is plugged into the electrical receptacle connector 100, the surface of the second tubular portion 21*b* is in contact with the conductive contact members or spring members 16 (shown in FIG. 3) of the electrical receptacle connector 100 so as to establish a low-impedance grounding path such that the electromagnetic interference (EMI) can be further reduced so as to meet the relevant EMI regulations. Since the conductive contact members or spring members 16 of the electrical receptacle connector 100 are connected with the second tubular portion 21*b* of the electrical plug connector 200, a low-impedance grounding path can be effectively established between the metal shell 21 of the electrical plug connector 200 and the metal shell 11 of the electrical receptacle connector 100 such that the electromagnetic interference (EMI) can be further reduced. In order to accommodate end users with the attribute of usability, durability, and robustness of USB connectors and also meet the requirement of the connector insertion force lower than extraction force when inserting a plug connector into a receptacle connector or extracting a plug connector from a receptacle connector, the amount of resistance between the metal shell 21 of the electrical plug connector 200 and the conductive contact members or spring members 16 can be reduced through reducing the contact area between the surfaces of the metal shell 21 of the electrical plug connector 200 and the conductive contact members or spring members 16. In addition, the amount of resistance between the metal shell 21 of the electrical plug connector 200 and the conductive contact members or spring members 16 can be controlled through the geometry, material selection, surface finishing and sizing of the conductive contact members or spring members 16. Furthermore, because the upper-row plate terminals 151 and the lower-row plate terminals 152 of the electrical receptacle connector 100 are arranged upside down, and the arrangement sequence of the upper-row contact sections 2514 are left-right reversal with respect to the arrangement sequence of the lower-row contact sections 2524, the electrical plug connector 200 is inserted into the interior of the electrical receptacle connector 100 with the plug terminals 25 of the electrical plug connector 200 contacting with the upper-row contact sections 2514 of the electrical receptacle connector 100 when being plugged by a forward orientation, and the electrical plug connector 200 is inserted into the interior of the electrical receptacle connector 100 with the plug terminals 25 of the electrical plug connector 200 contacting with the lower-row contact sections 2524 of the electrical receptacle connector 100 when being plugged by a reverse direction. Therefore, the inserting orientation of the electrical plug connector 200 is not limited, and can be forwarded or reversed, upon plugging into the electrical receptacle connector 100 according to the present invention.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metal shell defining a receptacle cavity;

an insulation housing received in the receptacle cavity, wherein the insulation housing comprises a base portion, a tongue portion extending from the base portion, and two recessed portions disposed at a top side and a bottom side of the base portion, respectively, the tongue portion comprising an upper surface and a lower surface;

a plurality of upper-row plate terminals, comprising a plurality of upper-row plate signal terminals, at least one upper-row plate power-supply terminal and at least one upper-row plate ground terminal, each of the upper-row plate terminals held in the base portion and the tongue portion and located at the upper surface;

a plurality of lower-row plate terminals, comprising a plurality of lower-row plate signal terminals, at least one lower-row plate power-supply terminal and at least one lower-row plate ground terminal, each of the lower-row plate terminals held in the base portion and the tongue portion and located at the lower surface;

two conductive contact members received correspondingly in the two recessed portions and connected to an inner wall of the metal shell, wherein each conductive contact member comprises:

a body portion;

at least one strip-shaped plate, extending and bending from the body portion to contact to the inner wall of the metal shell; and a plurality of elastic contact portions each extending from and protruding out of the body portion to correspond to the strip-shaped plate, and each contact portions suspended above and below the tongue portion.

2. The electrical receptacle connector according to claim 1, wherein the conductive contact members further comprise a plurality of mounting legs, bilaterally downwardly or upwardly extending from two opposite lateral sides of the strip-shaped plate, the base portion comprises a plurality of catching grooves arranged at two sides of the two recessed portions, thereby allowing the strip-shaped plate directly contacting with the inner wall of the metal shell.

3. The electrical receptacle connector according to claim 1, wherein each conductive contact member comprises a plurality of shaft portions arranged at two lateral sides of each body portion and the base portion comprises a plurality of bearing portions, which pivot with the corresponding shaft portions, formed at two lateral sides of the recessed portions, so that the strip-shaped plate contacts with the inner surface of the metal shell by the rotation of the shaft portions.

4. The electrical receptacle connector according to claim 1, wherein the metal shell comprises a plurality of taps extending downwardly and slantwise from a middle portion thereof for cooperating with the contact portions.

5. The electrical receptacle connector according to claim 1, further comprising a plurality of cutout areas of each conductive contact member formed at the elastic contact portions.

6. The electrical receptacle connector according to claim 1, wherein each of the upper-row plate terminals comprises an upper-row contact section, an upper-row connecting section and an upper-row welding section, the upper-row connecting section is disposed at the base portion and the tongue portion, the upper-row contact section is extending from one of two sides of the upper-row connecting section and disposed at the upper surface, the upper-row welding section is extending from the other side of the upper-row connecting section and extends out of the base portion.

7. The electrical receptacle connector according to claim 1, wherein each of the lower-row plate terminals comprises a lower-row contact section, a lower-row connecting section and a lower-row welding section, the lower-row connecting section is disposed at the base portion and the tongue portion, the lower-row contact section is extending from one of two sides of the lower-row connecting section and disposed at the lower surface, the lower-row welding section is extending from the other side of the lower-row connecting section and extends out of the base portion.

8. The electrical receptacle connector according to claim 1, wherein the upper-row plate signal terminals are disposed at the upper surface for transmitting first signals, the lower-row plate signal terminals are disposed at the lower surface for transmitting second signals, the transmission specifications of the first signals conform to those of the second signals, the upper-row plate terminals and the lower-row plate terminals are point-symmetrical with a central point of the receptacle cavity as the symmetrical center.

9. The electrical receptacle connector according to claim 8, wherein positions of the upper-row plate terminals correspond to those of the lower-row plate terminals.

10. An electrical plug connector, comprising:

a metal shell, comprising a first tubular portion, a second tubular portion, a plug cavity defined by the first tubular portion and a connecting portion extending from the first tubular portion where the first tubular portion and the second tubular portion form different surfaces;

an insulation housing received in the plug cavity, wherein the insulation housing comprises an upper portion, a lower portion and a terminal groove defined between the upper portion and the lower portion;

a plurality of upper-row elastic terminals, the upper-row elastic terminals comprising a plurality of upper-row elastic signal terminals, at least one upper-row elastic power-supply terminal and at least one upper-row elastic ground terminal, and each of the upper-row elastic terminals disposed at the insulation housing and located at a lower surface of the upper portion; and a plurality of lower-row elastic terminals, the lower-row elastic terminals comprising a plurality of lower-row elastic signal terminals, at least one lower-row elastic power-supply terminal and at least one lower-row elastic ground terminal, and each of the lower-row elastic terminals disposed at the insulation housing and located at an upper surface of the lower portion.

11. The electrical plug connector according to claim 10, wherein the first tubular portion and the second tubular portion are formed by applying deep-drawing techniques to the metal shell.

12. The electrical plug connector according to claim 10, wherein each of the upper-row elastic terminals comprises an upper-row contact section, an upper-row connecting section and an upper-row welding section, the upper-row connecting section is disposed at the upper portion, the upper-row contact section is extending from one of two sides of the upper-row connecting section and disposed at the lower surface of the upper portion, the upper-row welding section is extending from the other side of the upper-row connecting section and extends out of the insulation housing.

13. The electrical plug connector according to claim 1, wherein each of the lower-row elastic terminals comprises a lower-row contact section, a lower-row connecting section and a lower-row welding section, the lower-row connecting section is disposed at the lower portion, the lower-row contact section is extending from one of two sides of the lower-row connecting section and disposed at the upper surface of the lower portion, the lower-row welding section is extending from the other side of the lower-row connecting section and extends out of the insulation housing.

14. The electrical plug connector according to claim 10, wherein the upper-row elastic signal terminals are disposed at the lower surface of the upper portion for transmitting first signals, the lower-row elastic signal terminals are disposed at the upper surface of the lower portion for transmitting second signals, the transmission specifications of the first signals conform to those of the second signals, the upper-row elastic terminals and the lower-row elastic terminals are point-symmetrical with a central point of the plug cavity as the symmetrical center.

15. The electrical plug connector according to claim 14, wherein positions of the upper-row elastic terminals correspond to those of the lower-row elastic terminals.

* * * * *